US005332133A

United States Patent [19]

Murata et al.

[11] Patent Number: 5,332,133

[45] Date of Patent: Jul. 26, 1994

[54] POWDER SUPPLYING APPARATUS AND POWDER SPRAYING APPARATUS

[75] Inventors: Hiroshi Murata; Kimio Miyagawa; Eiji Shinoda, all of Saitama; Hideo Moriyama, Tokyo, all of Japan

[73] Assignees: Nisshin Flour Milling Co., Ltd.; Nisshin Engineering Co., Ltd., both of Tokyo, Japan

[21] Appl. No.: 969,365

[22] Filed: Oct. 30, 1992

[30] Foreign Application Priority Data

Nov. 1, 1991 [JP] Japan ..... 3-287879
Jun. 24, 1992 [JP] Japan ..... 4-166258

[51] Int. Cl.[5] ..... B05B 7/00

[52] U.S. Cl. ..... 222/630; 222/414; 239/346

[58] Field of Search ..... 222/345, 349, 394, 414, 222/630, 636, 637; 239/346, 364, 373

[56] References Cited

U.S. PATENT DOCUMENTS 3,221,938 12/1965 Yonkers et al. ..... 222/637 X
3,412,908 11/1968 Ferrault ..... 222/636
3,606,099 9/1971 Benson ..... 222/414 X
3,730,397 5/1973 Magnus ..... 222/414 X
4,184,258 1/1980 Barrington et al. ..... 222/636 X
4,474,327 10/1984 Mattson et al. ..... 222/630 X
5,161,473 11/1992 Landphair et al. ..... 222/630 X

*Primary Examiner*—Gregory L. Huson
*Attorney, Agent, or Firm*—Wenderoth, Lind & Ponack

[57] ABSTRACT

A powder supplying apparatus supplies, for example, a powder spraying apparatus with fine powder particles such as of ceramics having particle sizes of several μm to 10 μm at an extremely small rate of several grams to several tens of grams per hour, in the form of micronized discrete particles dispersed at a high degree of uniformity. The powder spraying apparatus is capable of spraying the fine powder particles on an object surface with a high degree of uniformity of distribution. The disclosed apparatus is used typically in uniformly spraying the above-mentioned fine powder particles which serve as spacers between a pair of transparent substrates of a liquid crystal display panel, for the purpose of maintaining a uniform and constant gap to be filled with a liquid crystal between these transparent substrates.

7 Claims, 18 Drawing Sheets

POWDER SUPPLYING APPARATUS AND POWDER SPRAYING APPARATUS

BACKGROUND OF THE INVENTION

1. Field of the Invention

The present invention in one aspect relates to an apparatus for supplying powder together with a gas and, more particularly, to an apparatus which can supply a trace amount of powder at a constant rate. Still more particularly, the present invention is concerned with a powder supplying apparatus capable of supplying, with time variation of the supply rate greatly suppressed, a trace amount of a fine powder to, for example, an apparatus which is used for spraying powder particles.

The present invention in its another aspect relates to a powder spraying apparatus which is used for, example, in spraying powder particles of an extremely small particle size ranging from several μm to 10 μm into a space between a pair of transparent substrates which form a liquid crystal panel so that a uniform gap is formed between these substrates by the powder particles which serve as spacers.

2. Description of the Related Art

There is an increasing demand for an apparatus which can continuously or consistently supplying, at a constant rate, inorganic or organic fine powder particles such as of a metal, ceramics or a plastic, as well as for an apparatus which can uniformly spraying such particles. Such demand exists in various industrial or technical processes such as plasma spraying process, process for producing a liquid crystal device, powder compressing process, sand blasting process or powder coating process.

A description will now be given of a process which is employed in production of a liquid crystal and which is a typical example of the processes which require the constant supply and uniform spraying of fine powder particles. A liquid crystal display panel of a liquid crystal display device has a pair of transparent substrates. A liquid crystal is charged so as to fill the gap between these substrates. Electrical fields are applied to suitable portions of this panel so that information such as patterns or characters are formed on the panel. In order that the size of the gap between the substrates is uniform over the entire area of the panel, it is necessary to charge fine powder particles serving as spacers between the pair of transparent substrates. In general, two types of methods are known for charging such spacers: namely, a method called "wet method" and a method called "dry method". According to the dry method, dispersed fine powder particles are sprayed onto one of the substrates by means of a nozzle, as shown in, for example, Japanese Patent Laid-Open No. 64-76031.

The fine powder particles used as the spacers between the pair of transparent substrates have extremely small particle sizes generally ranging between several μm and 10 μm. The size of the spacer powder particles directly affects the performance of the liquid crystal display panel. Therefore, various restrictions are posed such as the material of the powder, distribution of the particle size, and so forth. It is also necessary that the fine powder particles are completely separated into discrete state, for otherwise the size of the gap between the transparent substrates is rendered non-uniform due to presence of secondary particles which are formed as a result of aggregation of the powder particles. Thus, industrial production of liquid crystal display devices still involves problems to be solved. Furthermore, it is required that the discrete powder particles are uniformly sprayed over the entire area of the transparent substrate without any local concentration.

Generally, the requirement for the distribution of the fine powder particles is such that, for example, 30 to 200 particles are scattered in a unit area of 1 $mm^2$. The requirement is so severe that, when the design quantity of the fine powder particle per unit area is, for example, 50 particles, the allowable variation or fluctuation in the quantity of particles is as small as less than several to ten and several particles per unit area. Products which fail to meet this requirement are rejected as being defective. Consequently, the yield of the product is significantly lowered.

Various methods have been proposed for attaining the required uniform powder particle distribution. For instance, it has been proposed to spray the powder particles from a nozzle which is sufficiently spaced from the substrate, as well as a method in which the spray nozzle is made to revolve along a circular path, in order to attain a uniform distribution.

The condition for supplying the powder to the spraying apparatus, as well as the spraying method, is an important factor which affects the distribution of the fine powder particles. For instance, when the fine powder particles are continuously supplied from the nozzle, uniform distribution of the powder particles cannot be obtained unless fluctuation in the supply rate per unit time is minimized, even though the condition of spraying is strictly controlled.

To achieve uniform spray of powder particles, therefore, a specific powder particle supplying apparatus is used such as a screw feeder, a table feeder or a fluidized bed feeder.

Such a known powder supplying apparatus, however, essentially has a comparatively large movable part which optimumly operates when powder particles of large particle sizes are supplied in large quantity. This type of apparatus, however, is not suitable for use in cases where an extremely small rate of supply, e.g., several tens of grams per hour because in such cases it is extremely difficult to eliminate variation in the supply rate in relation to time. Consequently, the density of the powder particles is undesirably fluctuated, failing to meet the requirement for uniform distribution of the fine powder particles over the entire area.

The screw feeder type apparatus, which is one of the known powder supplying apparatus as described above, is disadvantageous in that the feeding condition undesirably varies depending on whether the screw is fully stuffed with the powder particles over its entire length or only partly stuffed with such particles as in the transient period immediately after start up of the supply or immediately before termination of the supply. Consequently, this type of powder supplying apparatus tends to lower the yield particularly when the production specifications pose strict requirements. This problem would be overcome if the products which are produced in such transient periods are disposed of, but such a measure leads to wasting of a large amount of powder which is quite inconvenient particularly when the powder is expensive.

SUMMARY OF THE INVENTION

Accordingly, an object of the present invention is to provide a powder supplying apparatus which is capable of stably supplying powder particles to a powder spraying apparatus, with maximized particle density and minimized fluctuation of the supply rate, thereby overcoming the above-described problems of the prior art.

It is another object of the present invention to provide a powder supplying apparatus which can stably supplying fine powder particles at a constant rate, without any transient phenomenon, from the beginning to the end of operation of the powder supplying apparatus.

It is still another object of the present invention to provide a powder supplying apparatus employing fewer mechanical movable parts and, hence, having a reduced size, while reducing introduction of impurities or contaminants which are generated as a result of contact between movable mechanical parts and wear of such parts.

It is a further object of the present invention to provide a powder supplying apparatus suitable for use in the production of liquid crystal display devices, improved to meet requirements in regard to the material and the particle size posed on spacer particles charged between the pair of substrates, thereby reducing the production cost while saving precious natural resources.

It is a still further object of the present invention to provide a powder spraying apparatus which has a reduced size and which can reduce consumption of powder which is extremely expensive, thereby simultaneously satisfying demands for reduction in the production cost and effective use of natural resources.

According to one aspect of the present invention, there is provided a powder supplying apparatus, comprising: a power storage section; a rotary member rotatable above a fixed axis and having a circumferential groove formed in the peripheral surface thereof, the groove extending in the direction of rotation and being adapted to be charged by powder; powder charging means for charging the circumferential groove with the powder from the powder storage section continuously at a constant rate in accordance with the rotation of the rotary member; a powder discharging elongated tube having an opened facing the opening of the circumferential groove leaving a minute gap therebetween; a vessel which defines a space which accommodates the rotary member and the open end of the elongated tube and which is sealed from the ambient air; and means for establishing a predetermined gas pressure differential between the other end of the elongated tube and the interior of the vessel so as to create a continuous flow of gas from the interior of the vessel towards the other end of the elongated tube.

No specific restriction is posed regarding the form of the rotary member used in this apparatus. For instance, the rotary member may be in the form of a roll, a drum or an endless belt having a circumferential groove in its surface. The material of the rotary member also has no restriction, although a metal such as a stainless steel, aluminum or brass is preferably used. The dimensions of the circumferential groove formed in the surface of the rotary member depend on the particle size, stickiness and density of the powder particles, as well as the rate of supply of the powder. For instance, when the supply rate is 0.5 to 70 grams per hour, the circumferential groove may have a width of 0.2 to 5 mm and a depth of 0.1 to 2 mm. When the rotary member is a roll, good results are generally obtained when the roll diameter ranges between 30 and 200 mm while the rotation speed is between 0.1 and 10 rpm. The circumferential groove may have various cross-sections which facilitate scattering of the powder, such as a rectangular cross-section or an inverse trapezoidal cross-section which diverges radially outward.

The rotary member such as a roll or a drum may be laid to rotate about a horizontal axis. In such a case, the circumferential groove is formed in the outer peripheral surface of the roll or drum. Alternatively, the roll or the drum is disposed so as to rotate about a vertical axis. In such a case, the circumferential groove is formed in the top surface, i.e., upper axial end surface, of the roll or drum.

The powder discharging elongated tube is so arranged that an open thereof faces the opening of the circumferential groove of the rotary member leaving a predetermined minute gap therebetween, thus forming a powder scattering portion. The size of the gap is preferably adjustable based on the rate of supply of the powder or the velocity of the powder. The size of the gap usually ranges optimumly between 0 and 5 mm, and the diameter of the tube generally is as small as 1 to 10 mm.

According to the invention, the rotary member and associated parts are accommodated in a vessel, and a gas is supplied such as to flow from the space inside the vessel into the elongated tube facing the opening of the circumferential groove in the rotary member, whereby the powder charged in the circumferential groove is involved by the gas so as to be introduced into the elongated tube. Namely, the powder in the circumferential groove is trapped by the gas flowing into the tube through the gap between the tube and the circumferential groove, due to viscosity of the gas.

The flow of the gas into the elongated tube can be generated either by supplying the gas under pressure into the vessel or by reducing the pressure in the elongated tube, while hermetically sealing the interior of the vessel. When the latter type of gas supplying means is used, the reduction of the pressure in the tube may be effected by means of an ejector connected to the downstream end of the tube.

As the powder charging means for charging the powder into the circumferential groove, it is possible to use, for example, a roll which rotates in contact with the rotary member and which preferably has circumferentially consecutive concavities and convexities in its peripheral surface. This roll is referred to as powder pressing roll, hereinafter. This powder pressing roll may be of a type which has a circumferential ridge only at a portion thereof facing the circumferential groove in the rotary member or may be of a type which has a smooth surface over its entire axial length. The bottom surface of the circumferential groove formed in the surface of the rotary member is preferably toughened or provided with consecutive concavities and convexities appearing in the direction of rotation.

The powder pressing roll is provided in a powder storage section which is arranged to allow the powder therein to contact a portion of the peripheral surface of the rotary member inside the vessel. Preferably, an agitating device such as of a type having agitating blades is preferably disposed in the powder storage section, in order to supply the powder into the nip between the powder pressing roll and the rotary member without discontinuity.

According to the present invention, the scraper means is provided for the purpose of scraping the powder off the peripheral surface of the rotary member. This scraping means doctors the surface of the powder charged in the circumferential groove, while removing any excess powder from the surface of the rotary member. This ensures that an average amount of the powder is continuously supplied into the elongated tube, realizing a substantially constant rate of supply of the powder.

Powder particles may have been stuck on one another to form aggregates but such aggregates are dispersed into discrete particles due to collision with the tube wall during the conveyance along the tube. In order that an appreciable dispersion effect is obtained, it is preferred that the elongated tube has a diameter of 2 to 10 mm and a length which is about 10 times as large the diameter. When the ejector is used as means for supplying the gas, the length of the tube can be reduced without losing the dispersing effect, because the ejector produces an appreciable dispersing effect. In order to enhance the dispersing effect through the tube, it is preferred that the tube has a portion where the flowing velocity which is determined based on the type of the particles and the particle size is between 20 to 300 m/s or higher.

The effect of the present invention for supplying a powder at a constant rate is enhanced when the elongated tube through which the powder is delivered has the following construction. More specifically, the elongated tube employed in the powder supplying device of the invention is provided at its intermediate portion with a shunting/merging section where the tube is branched into two branch tubes which then merge with each other. The branch tubes may have different lengths so that pulsation occurring in one branch tube and the pulsation occurring in the other branch tube cancel each other so as to reduce pulsation of the pressure in the elongated tube.

Namely, the pressure of the gas carrying the powder supplied into the elongated tube pulsates at a substantially constant period. However, by determining the lengths of the branch tubes such that the phases of the pulsations in both branching tubes are offset half period at the merging point where two branch tubes merge with each other, the pulsation occurring in the portion of the elongated tube downstream of the merging point is remarkably suppressed.

According to another aspect of the present invention, there is provided a powder spraying apparatus, comprising: a spray nozzle for spraying a powder onto upper surface of a substrate, e.g., a transparent substrate of a liquid crystal display panel, from the upper side of the latter; and a moving mechanism for causing relative movements between the spray nozzle and the substrate both in x- and y-axis directions, the moving mechanism being capable of moving at least one of the spray nozzle and the substrate such that the point where the extension of the spray nozzle intersects the surface of the substrate draws a zig-zag locus.

There is no restriction in regard to the moving mechanism for causing the relative movement between the spray nozzle and he substrate. For instance, the moving mechanism may employ a cam mechanism which causes the spray nozzle to oscillate with respect to the substrate both in x- and y-axis directions parallel to the substrate. Alternatively, the moving mechanism may employ a first moving mechanism which moves the substrate in x-axis direction, and a second moving mechanism which moves the substrate reciprocatingly in y-axis direction, i.e., a mechanism for driving the spray nozzle reciprocatingly along a line. The moving mechanism of the second type employing the first and second mechanisms can advantageously be employed in spraying a powder on a multiplicity of substrates which are supplied successively.

The term "zig-zag" means that the extension of the spray nozzle draws a continuous locus on the substrate so as to realize uniform distribution of the powder without substantial overlap. In order to realize a uniform distribution while minimizing the amount of display, it is recommended that the extension of the spray nozzle draws a rectangular wave as shown in FIG. 22. However, almost the same effect is attained when the locus is a saw-tooth zig-zag wave which can be realized a comparatively simple oscillating mechanism. In such a case, the belt-like region of spray of the powder having a certain width existing on both sides of the neutral line of the saw-tooth wave may have partial overlap provided that the fluctuation in the number of particles per unit area is within an allowable range.

In order to minimize the consumption of the powder, it is desirable that the spray is conducted in such a manner that the powder is sprayed to a desired region on the substrate in an amount which is necessary and sufficient. The powder handled by the present invention is, for example, powder particles of plastics, silica or glass.

In the powder supplying apparatus of the present invention, the circumferential groove formed in the peripheral surface of the rotary member is uniformly charged with the powder, and the powder is continuously fed into the elongated tube by being scattered and suspended by the gas flowing into the opening of the elongated tube facing the circumferential groove. Consequently, the density of the powder particles fed into the elongated tube is rendered constant, thus realizing a controlled supply of trace amount of powder at a rate of several tens of grams or less per hour which hitherto has been impossible.

Conditions such as the rotation speed of the rotary member, width and depth of the circumferential groove and pressure difference can easily be selected in accordance with the nature of the powder such as stickiness of the powder particles.

The powder spraying apparatus of the invention, which is suitably combined with the powder supplying apparatus described above, can reduce the distance between the substrate and the nozzle to half or less the distance adopted in known spraying apparatus in which the nozzle is moved along a circular path, for a given design specification of the spraying accuracy.

Furthermore, the surplus area of spray outside the aimed spray area is remarkably reduced. Judging from the area ratio, the consumption of the powder can be reduced by several tens of percents.

The powder spraying apparatus of the present invention is preferably and suitably combined with the above-described powder supplying apparatus which is capable of supplying the powder in such a state that the powder is dispersed in the form of discrete primary particles without aggregation.

The use of such a powder supplying apparatus ensures that the powder is maintained in the form of dispersed primary particles during transportation from the powder supplying apparatus to the spray nozzle. Namely, the powder supplying apparatus can supply the powder at a regulated constant rate, and the dispersion of the powder into discrete particles is further enhanced during the conveyance through the elongated tube because the powder is suspended by the high-velocity air flowing through the elongated tube.

The powder spraying apparatus of the present invention can be used for various powder spraying purposes, in particular for spraying powder particles which serve as spacers between pair of substrates of an electro-optical device using liquid crystal.

BRIEF DESCRIPTION OF THE DRAWINGS

FIG. 7(*b*) is a sectional side elevational view of the apparatus shown in FIG. 7(*a*);

FIG. 9(*b*) is a sectional side elevational view of the apparatus shown in FIG. 9(*a*);

DESCRIPTION OF THE PREFERRED EMBODIMENTS

Preferred embodiments of the present invention will be described with reference to the accompanying drawings.

EMBODIMENT 1

Figure 1:
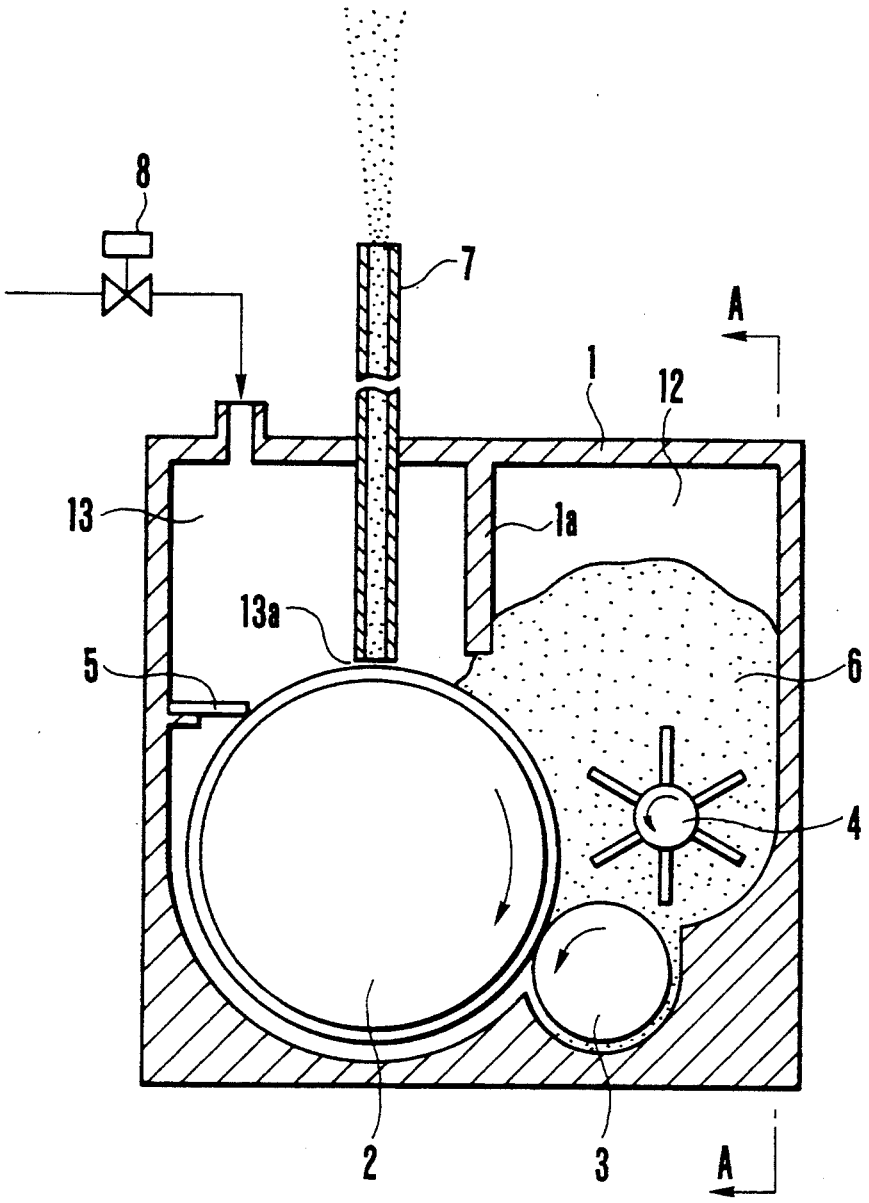
FIG. 1 is a sectional view of a powder supplying apparatus as the first embodiment of the present invention.
Figure 2:
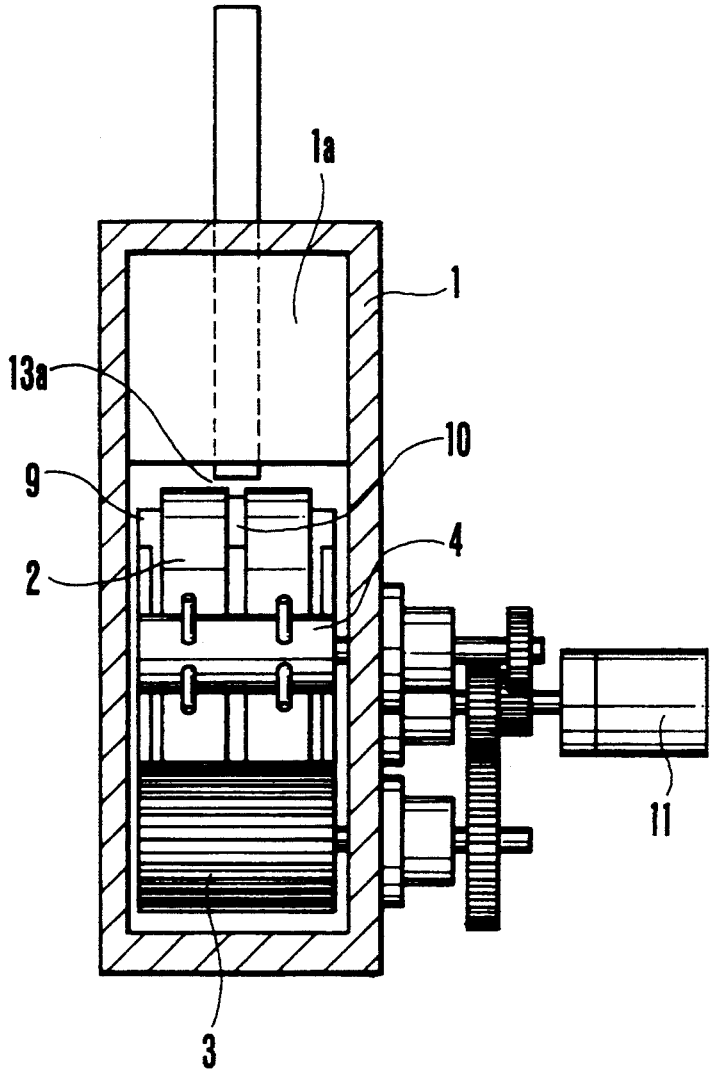
FIG. 2 is a sectional view taken along the line A—A of FIG. 1.

FIG. 1 is a sectional view of a powder supplying apparatus as a first embodiment of the present invention, while FIG. 2 is a sectional view taken along the line A—A of FIG. 1.

Referring to these Figures, the powder spraying apparatus has a vessel 1 forming a main part of the apparatus. The vessel 1 has a hermetic structure so as to seal the interior from the ambient air.

The vessel 1 has a partition wall 1*a* which divides the interior space of the vessel 1 into two sections: namely, a first chamber 12 which forms a powder storage section and a second chamber 13 which forms a powder scattering section.

The second chamber 13 accommodates a grooved roll 2 having a circumferential groove 10 which is to be charged with a powder. The grooved roll 2 forms, in combination with a later-mentioned powder delivering elongated tube, a powder scattering portion 13*a*. The grooved roll 12 is adapted to be driven by an external motor 11 shown in FIG. 2.

A small-diameter powder pressing roll 3 is disposed in a lower portion of the first chamber 12 forming the powder storage section. The powder pressing roll has a peripheral surface provided with axial ridges and valleys which appear alternately and consecutively in the circumferential direction. The powder pressing roll 3 is pressed onto the grooved roll 2 for rotation in contact therewith. As will be seen from FIG. 2, the powder pressing roll 2 is adapted to be driven by the power derived from the above-mentioned motor 11 through a gear train. Thus, two grooved roll 2 and the powder pressing roll 3 are driven by the con, non motor 11 in synchronization with each other. The first chamber 12 is adapted to be charged with a powder 6 supplied through a powder supply port which is not shown.

Numeral 4 denotes a bladed agitator disposed in the first chamber 12 at a position which is upstream of the nip between the grooved roll 2 with the peripheral grove 10 and the powder pressing roll 3 as viewed in the direction of rotation. The bladed agitator 4 rotates in the direction of the arrow in FIG. 1 so that the stored powder is continuously supplied into the upstream side of the nip between two rolls 2 and 3. In the illustrated embodiment, this bladed agitator 4 also is driven by the above-mentioned motor 11 through a gear train.

Numeral 7 designates an elongated tube having an open lower end which faces the circumferential groove 10 of the grooved roll 2 leaving a predetermined gap therebetween. Thus, the grooved roll 2 and the elongated tube 7 in cooperation form a powder fluidizing section 13*a* in which the powder charged in the circumferential groove 7 is fluidized and introduced into the elongated tube 7. Preferably, the gap between the lower open end of the elongated tube 7 and the circumferential groove 10 is adjustable. Such adjustment can be realized by an ordinary screw mechanism (not shown) or other suitable mechanism.

Numeral 5 designates a scraper fixed to the vessel and held in contact with the rotary grooved roll 2 so as to scrape powder off the peripheral surface of the roll 2, while leveling the surface of the powder layer in the circumferential groove 10 with the outer peripheral surface of the roll 2.

In the embodiment shown in FIG. 1, small-diameter step portions are formed on both side portions of the grooved roll 2 which serve as powder returning portions 9 which allows the powder scraped by the scraper 5 to return into the powder storage section, thereby preventing impediment to the rotation of the roll 2 which may otherwise be caused by stagnation of the powder scraped off the roll 2.

Numeral 8 designates a valve which is provided in a tube for introducing a pressurized gas into the second chamber in the vessel 1. The rate of introduction of the gas can be adjusted by varying the degree of opening of this valve 8.

The pressurized gas flows into the elongated tube 7 accompanied by the powder fluidized in the powder fluidizing section 13*a*.

In operation, the powder 6 is supplied into the first chamber 12 serving as the powder storage section, through the powder supply port which is not shown. The powder is then agitated by the bladed agitator 4 and is forced into the circumferential groove 10 in the grooved roll 2 by the operation of the powder pressing roll 3. The powder introduced into the circumferential groove 10 is then leveled by the scraper 5 and is moved to the powder fluidizing section 13*a*. The portion of the powder scraped by the scraper 5 off the roll 2 is returned to the powder storage section through the above-mentioned powder returning portions 9 in the form of small-diameter steps.

The powder charged in the circumferential groove 10 is moved to the powder fluidizing section 13*a* where the lower open end of the elongated tube 7 faces the circumferential groove 10. In this section, gas is flowing from the powder storage section of elevated pressure into the elongated tube 7. The powder 6 in the circumferential groove 10 is then blown by the gas so as to be fluidized and trapped by the gas and flows into the elongated tube 7 together with the gas. The powder moves along the tube while repeatedly colliding with the tube wall surface, so that any aggregate of the powder particles is micronized into discrete particles.

TEST EXAMPLE 1

Figure 3:
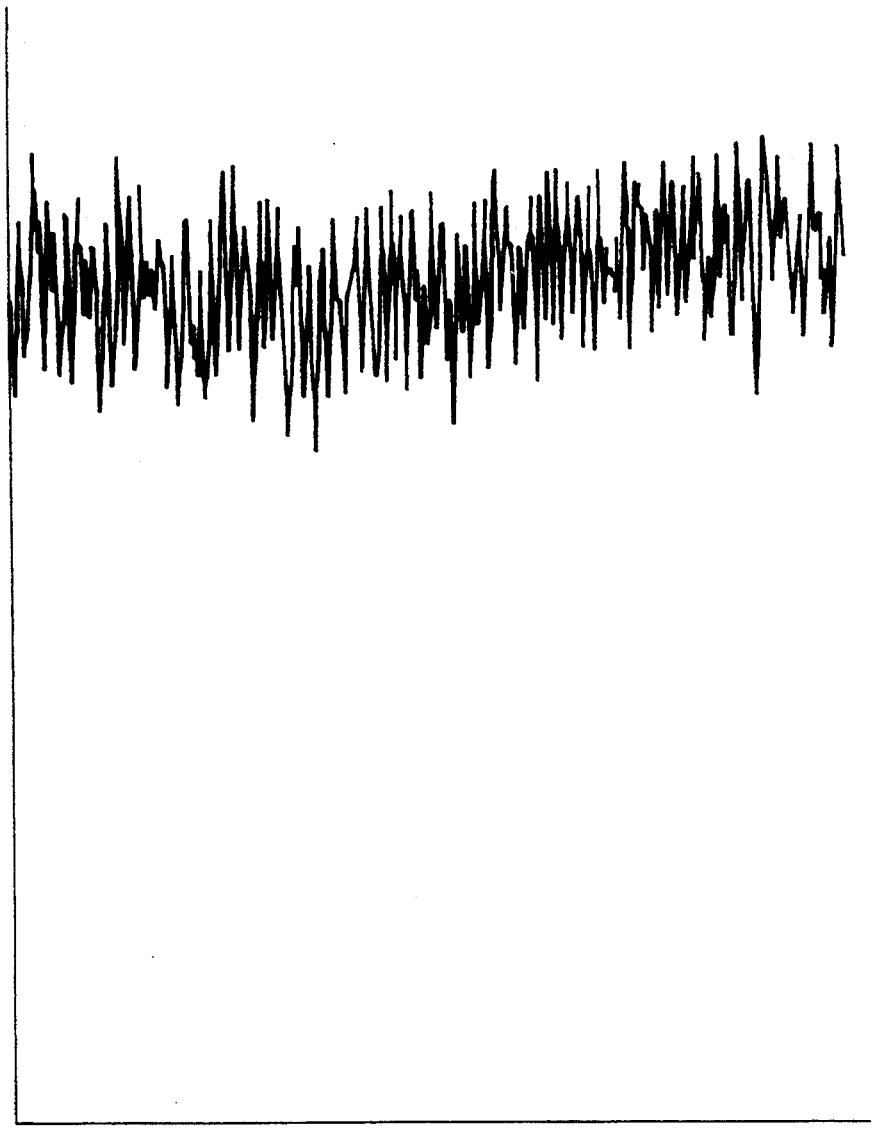
FIG. 3 is a chart showing a powder particle densitometer which measures the density of powder particles supplied by the powder supplying apparatus of FIG. 1.

A test was conducted to measure time variation of the flow rate of the powder in the elongated tube of the apparatus having the construction described hereinbefore. The test was conducted under the following conditions and the results of the test are shown in FIG. 3. The measuring conditions also are shown below.

| Construction of apparatus: | |
|---|---|
| Grooved roll | |
| Diameter of grooved roll | 100 mm |
| Width of circumferential groove | 1.4 mm |
| Depth of circumferential groove | 0.5 mm |
| Powder | |
| Type of powder | Acrylic resin powder |
| Mean particle size of powder | 8 m |
| Type of gas supplied into second chamber | air |
| Pressure in second chamber elevated by pressurized gas | 1.0 kg/cm$^2$ |
| Diameter of elongated tube | 3 mm |
| Velocity of gas flowing in tube | 30 mm/sec. |

Measuring Method

Figure 5:
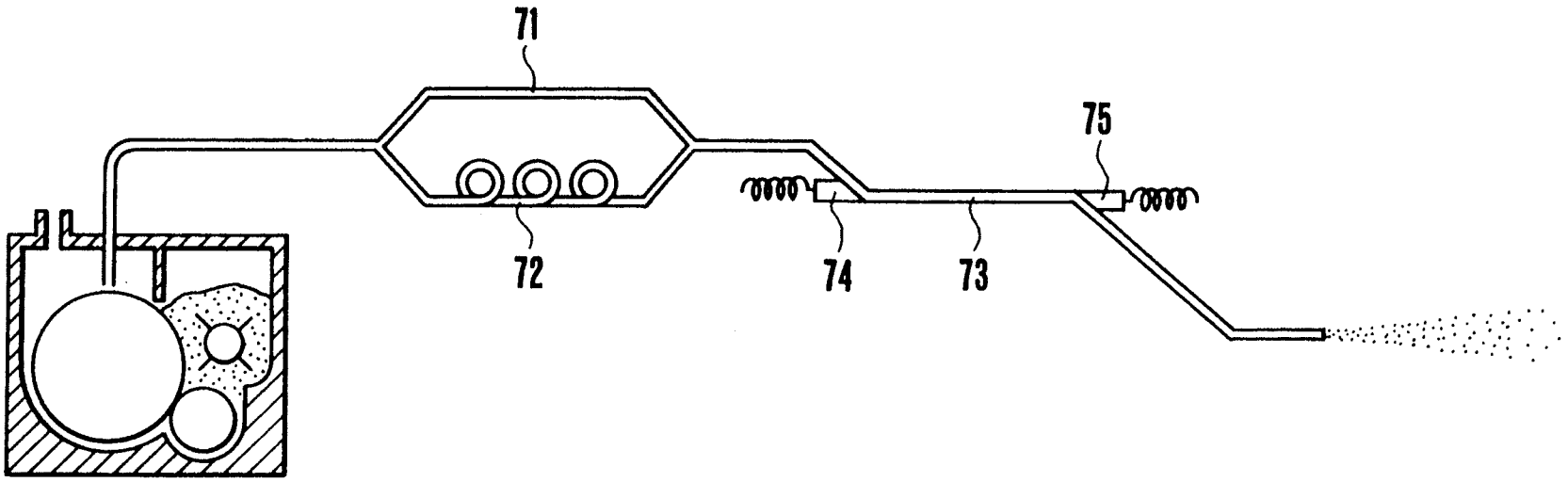
FIG. 5 is a schematic illustration of a third embodiment having a mechanism for suppressing pressure pulsation.

Measurement was conducted by using an apparatus shown in FIG. 5, including a light emitting device 74 disposed on one side of a straight portion 73 of the elongated tube and a light receiving device 75 disposed on the other side of the straight tube portion 73. The light emitting device 74 emits a laser beam which is received by the light receiving device 75 and the quantity of light received by the light receiving device 75 is converted into a voltage signal by a photoelectric converter employing a photo-cell. The flow rate of the powder particles through the elongated tube was measured and evaluated in the form of the voltage value, based on the voltage output obtained when no powder flows through the elongated tube and the voltage output indicative of voltage attenuation observed when the powder flows through the tube at a reference flow rate.

From the test results shown in FIG. 3, it is understood that the rate of supply of the powder through the tube to the downstream apparatus was regulated to a substantially constant value of 10±1 mg per second, i.e., less than several tens of grams per hour, which could never be attained by known apparatuses, although a slight pulsating variation was observed.

EMBODIMENT 2

Figure 4:
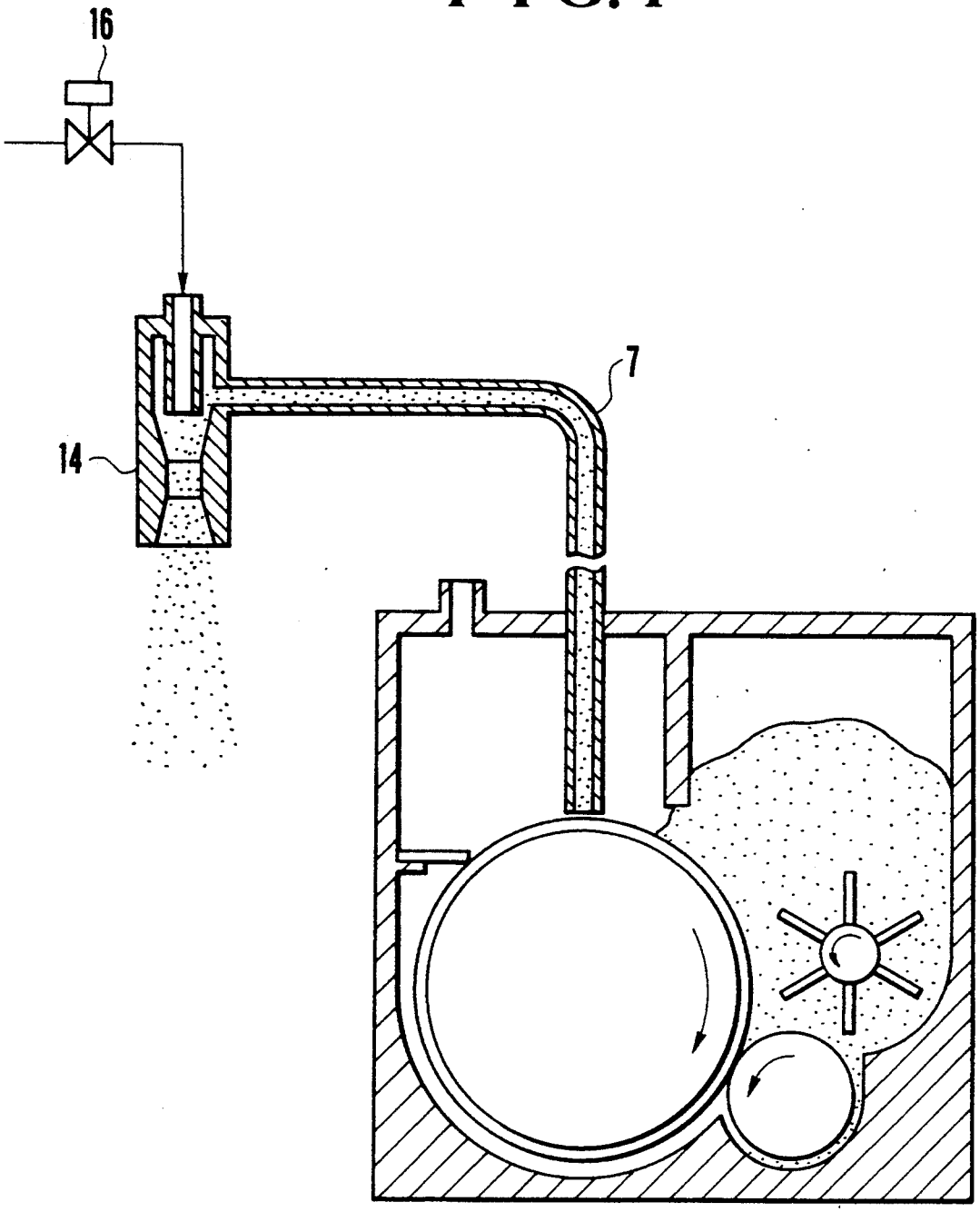
FIG. 4 is a sectional view of a powder supplying apparatus as a second embodiment.

FIG. 4 is a schematic illustration of a second embodiment. The construction of the powder supplying apparatus 1 is not described since it is identical to that shown in FIGS. 1 and 2. The second embodiment features the use of an ejector 14 which is connected to downstream portion of the elongated tube so as to induce gas in the tube. Thus, the ejector 14 reduces the pressure in the tube so as to induce gas from the region around the open end of the tube, thus serving as the means for fluidizing the powder 6 into the elongated tube 7.

This embodiment offers, in addition to the advantages produced by the first embodiment, an additional advantage in that micronization of any aggregate of powder in the elongated tube is enhanced by the effect of the ejector which elevates the velocity of the gas and powder flowing in the tube.

EMBODIMENT 3

FIG. 5 is an illustration of an embodiment in which a device for suppressing pulsation of pressure of the gas suspending the powder particles is associated with a downstream portion of the elongated tube. Pulsating variation in the rate of supply of the powder from the powder supplying apparatus may occur due to, for example, the nature of the powder, as explained above in connection with FIG. 3. In this embodiment, such pulsating variation is avoided by the following means. In this embodiment, the elongated tube 7 shunts at is intermediate portion into two branch tubes 71 and 72 which then merge with each other at a point downstream of the shunting point. The branch tube 72 has a length greater than that of the other branch tube 71. In order to suppress pulsation at the downstream side of the merging point, the lengths of the branch tubes 71 and 72 are so selected that the difference in the length produces a phase difference of pulsation by half period of the pulsation between two branch tubes.

Figure 6:
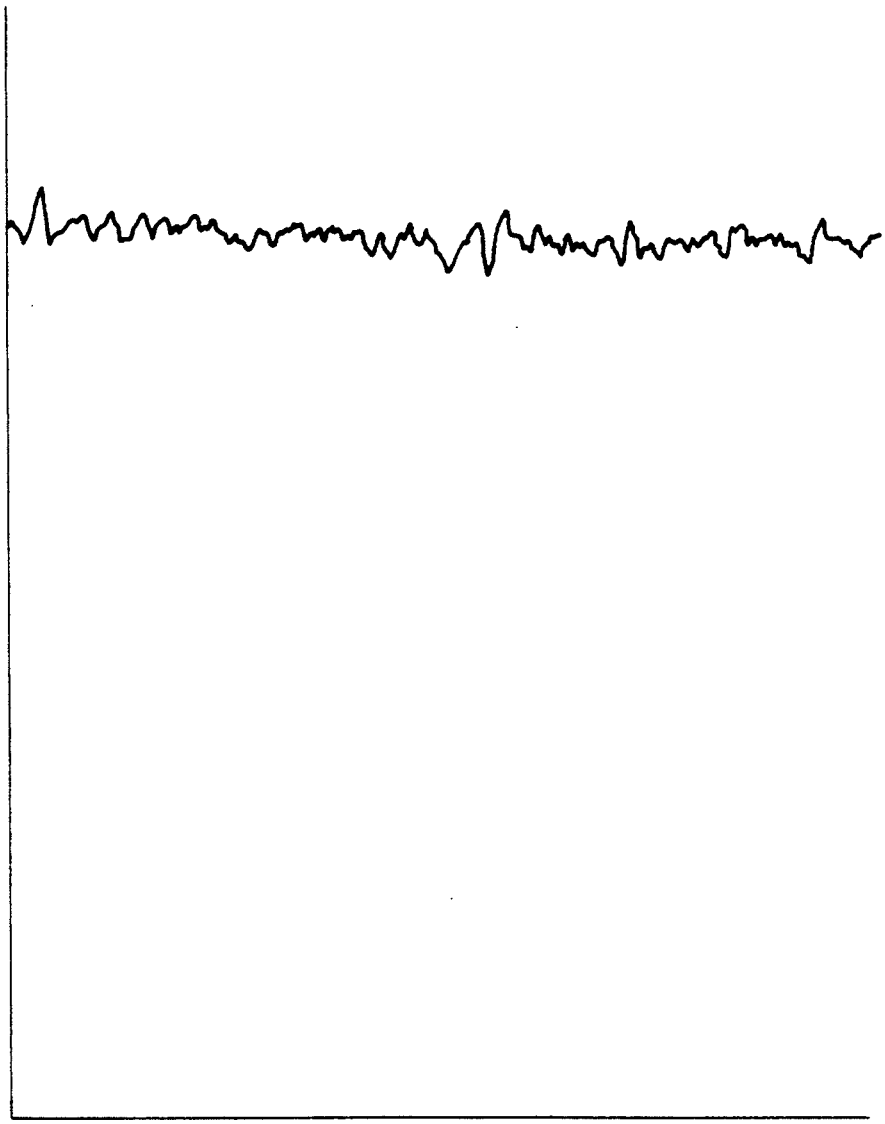
FIG. 6 is a chart showing a powder particle densitometer which measures the density of powder particles supplied by the powder supplying apparatus of FIG. 3 having the mechanism for suppressing pressure pulsation.

The pulsation suppressing mechanism shown in FIG. 5 was used in the apparatus shown in FIG. 1 and the variation in the powder supply rate at the downstream side of the merging point was measured by the same method as the first embodiment to obtain results as shown in FIG. 6.

In this embodiment, the elongated tube had a diameter of 4 mm and the first and second branch tubes respectively were 2 mm diameter and 3 m long and 3 mm diameter and 4.5 m long.

As will be understood from FIG. 6 showing the test results, the powder supply rate in terms of the output from the powder particle densitometer was as small as $10\pm0.2$ mg per second. Thus, the variation in the powder supply rate was remarkably improved over that obtained in the first embodiment, thus attaining a higher effect in regulating the powder supply rate to a constant value.

The above-described pulsation suppressing mechanism may be used in any field which requires supply of powder at constant rate, independently of the powder supplying apparatus of the present invention.

EMBODIMENT 4

Figures 7A, 7B:
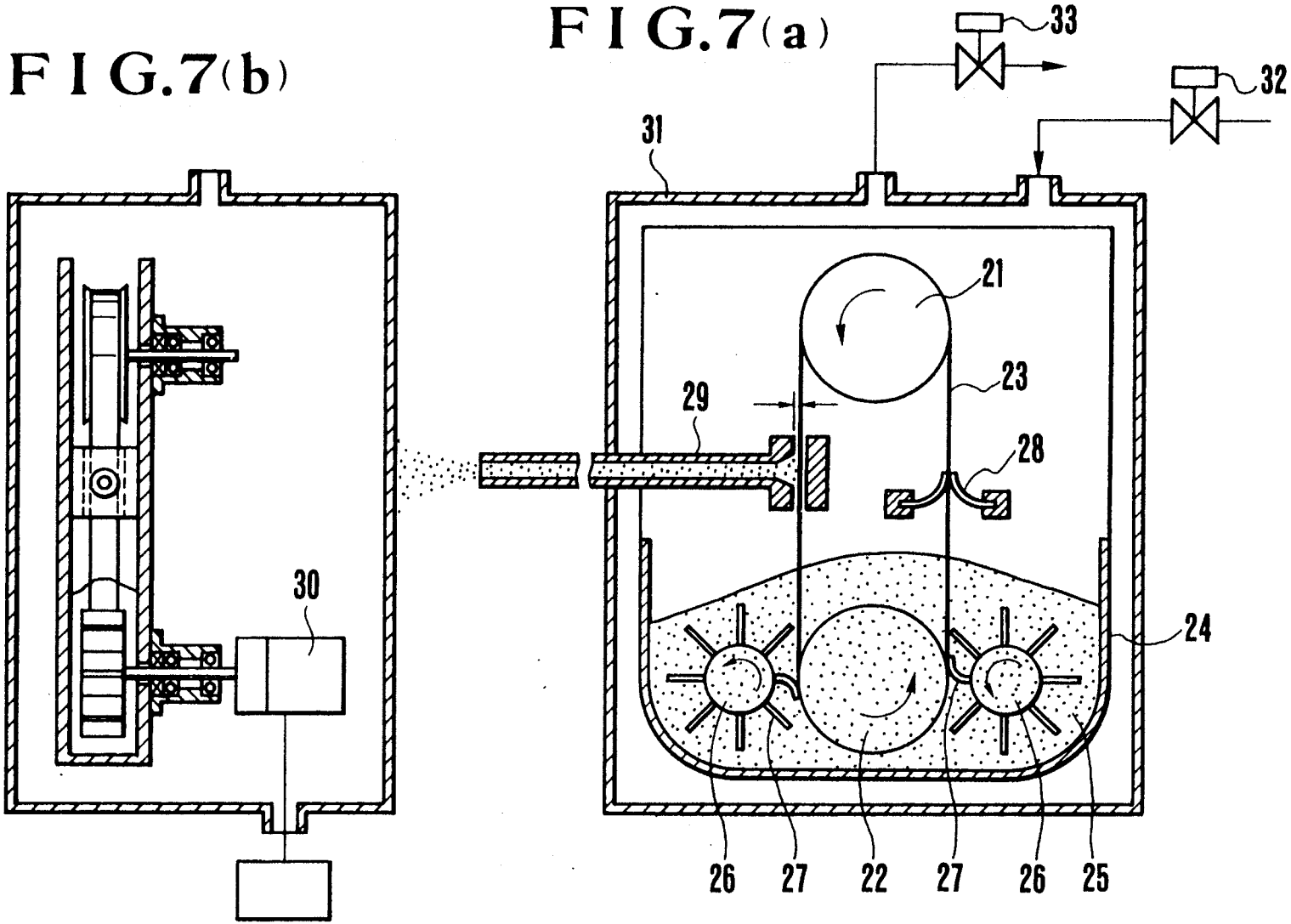
FIG. 7(*a*) is a sectional front elevational view of a powder supplying apparatus as a fourth embodiment.

FIG. 7 shows an embodiment which is distinguished from the preceding embodiments in that it employs, in place of the rotary grooved roll used in preceding embodiments, an endless belt 23 which has no circumferential groove. Consequently, the construction and arrangement associated with the endless belt are adopted in place of those used for the rotary rolls of the preceding embodiments, but other portions have almost the same constructions.

More specifically, the endless belt 23 is wound around a pair of vertically spaced pulleys 21 and 22. The lower pulley 22 which is a driving pulley is embedded in a powder 25 stored in a hopper 24. A deposition roll 26 having resilient blades 27 presses and deposits the powder onto the surface of the belt, as illustrated. A scraper 28 for doctoring the powder layer on the belt surface is disposed at a position near the run of the endless belt 23. Similarly, an elongated tube 29 is disposed such that one open end thereof faces the outer surface of the belt leaving a predetermined gap therebetween. Numeral 30 designates a motor for driving the above-mentioned drive pulley 22, while 31 designates a vessel which accommodates the components described hereinbefore. A regulating valve 32 is provided in an intermediate portion of a tube which introduces a pressurized gas into the vessel. Numeral 33 denotes a relief valve.

According to this arrangement, the powder forming a thin layer on the surface of the endless belt 23 can be continuously delivered through the elongated tube 29 at a constant rate. In this embodiment, the inlet opening of the elongated tube 29 facing the belt 23 is conically formed so as to diverge towards the belt 23. This conical form of the tube inlet may also be used in the first to third embodiments described before. The geometry of the cone is suitably selected to optimize the flow rate of the gas flowing from the vessel 31 into the tube 29.

EMBODIMENT 5

Figure 8:
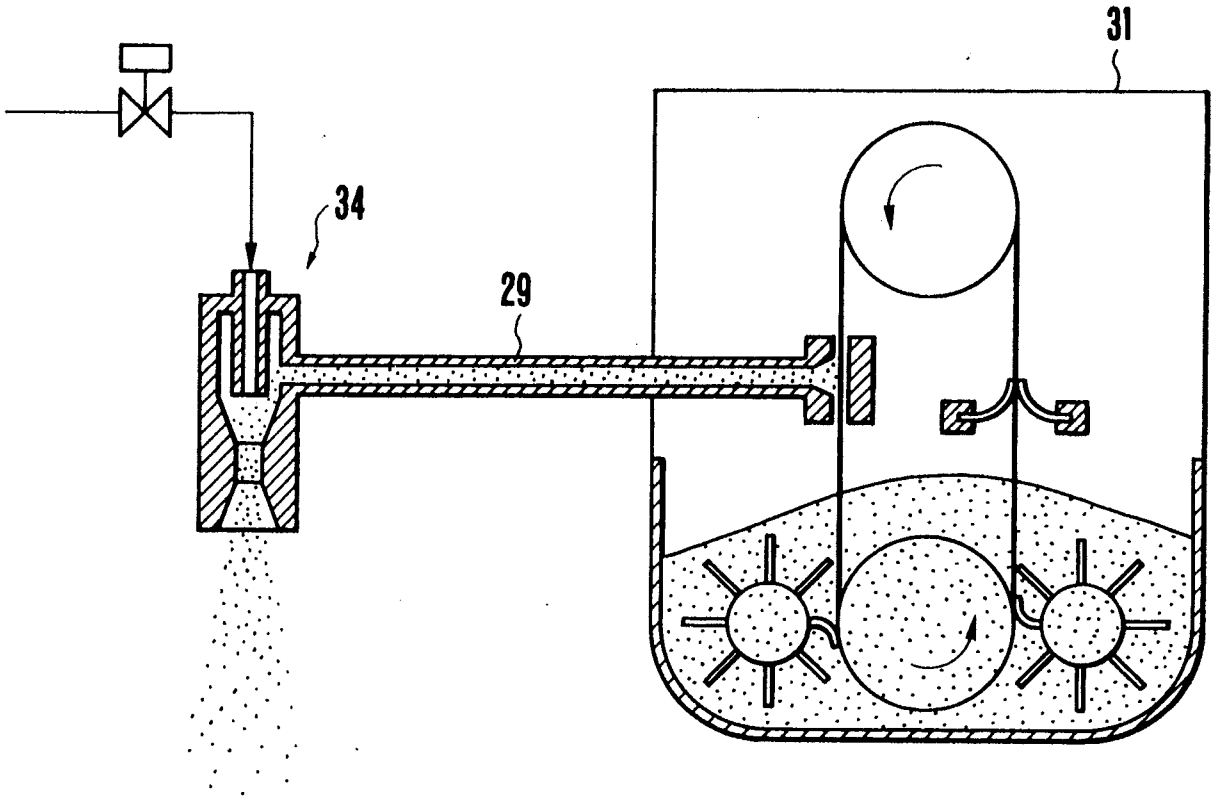
FIG. 8 is a sectional view of a powder supplying apparatus as a fifth embodiment of the present invention.

FIG. 8 shows a fifth embodiment in which an ejector 34, which is of the same type as that used in the second embodiment shown in FIG. 4, is used in combination with the apparatus of the fourth embodiment, for the purpose of creating the flow of the gas from the interior of the vessel into the elongated tube. Thus, the fifth embodiment offers the same advantages as those produced by the second and fourth embodiments.

EMBODIMENT 6

Figure 9A:
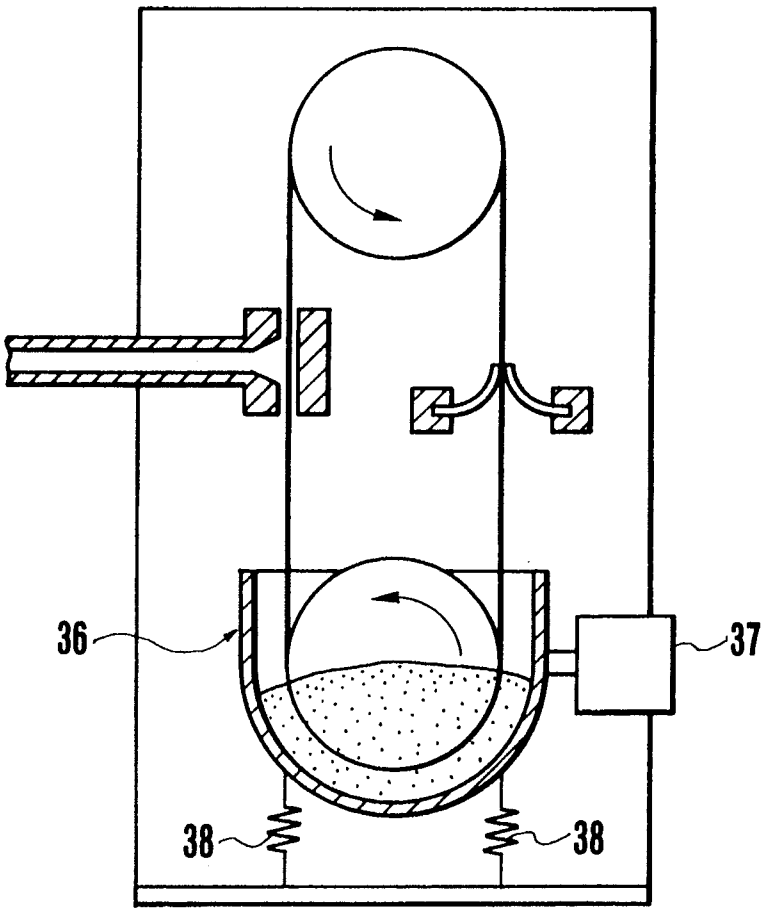
FIG. 9(*a*) is a sectional front elevational view of a powder supplying apparatus as a sixth embodiment.
Figure 9B:
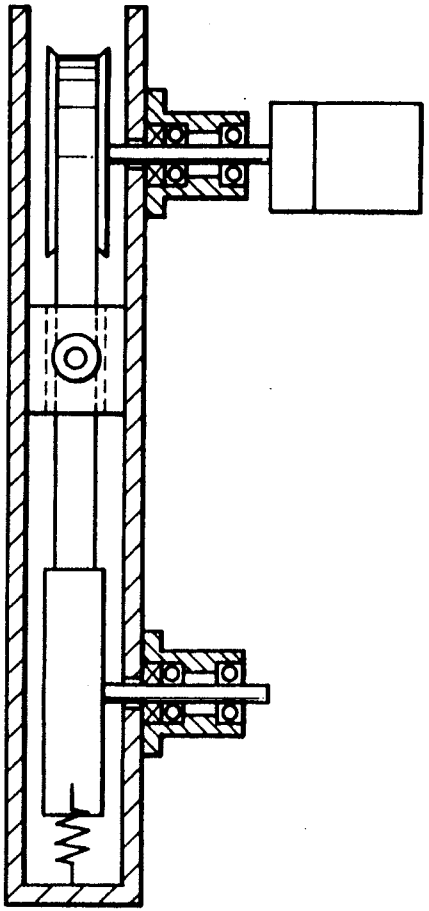

FIG. 9 shows a sixth embodiment which is basically the same as the fourth embodiment, except that the driving pulley 22 is disposed in contact with the powder stored in a hopper 36 which is supported by a spring 38 for vibration. This embodiment therefore produces substantially the same effect as the fourth embodiment.

EMBODIMENT 7

Figure 10:
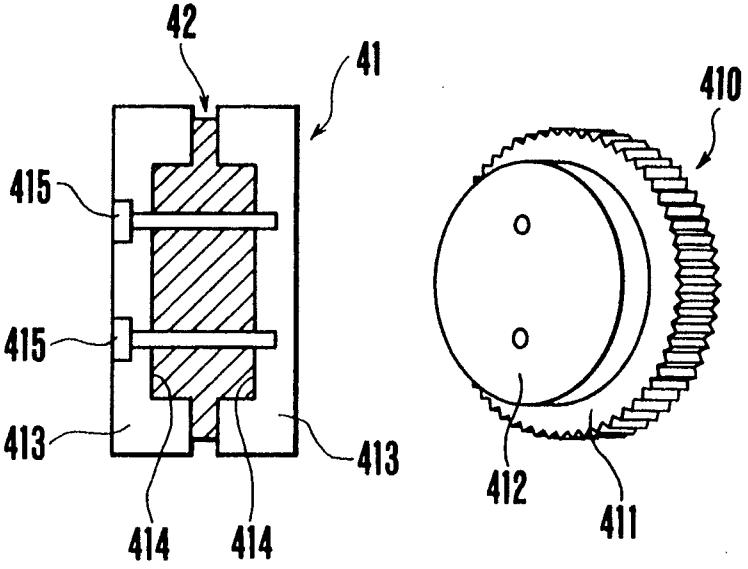
FIG. 10 is an illustration of a rotary member employed in the powder supplying apparatus of the present invention and having circumferentially consecutive convexities and concavities formed in the bottom of a circumferential groove.

FIG. 10 shows a seventh embodiment which has a grooved roll 41 having a circumferential groove 42, similar to the rolls used in the first and other embodiments. In this embodiment, the circumferential groove 42 has a bottom surface provided with circumferentially consecutive concavities and convexities similar to gear teeth. More specifically, this grooved roll 41 includes a stepped roll 410 having a large-diameter axially mid portion 411 with concavities and convexities, and both axial end portions 412 of a reduced diameter. The grooved roll 41 also has flanged rolls 413, 414 having bores fitting the reduced-diameter portions 412 and secured thereto by means of bolts 415. The flanged rolls 413 have a diameter greater than that of the large-diameter portion 411 of the roll 410. Consequently, the peripheral surface of the large-diameter portion 411 of the stepped roll 410 provides a surface which forms the bottom of the circumferential groove 42 and which has concavities and convexities consecutive in the circumferential direction.

The grooved roll 41 of this embodiment offers an advantage in that the powder charged in the circumferential groove is securely retained in the concavities without coming off the roll. In addition, sucking of the powder in the powder fluidizing section is facilitated by virtue of the fact that the powder exists in discrete concavities, whereby the time variation in the rate of supply of the powder is further suppressed. The circumferential pitch of the convexities and concavities is, for example, 0.02 mm. Although this value is not essential.

Figure 11:
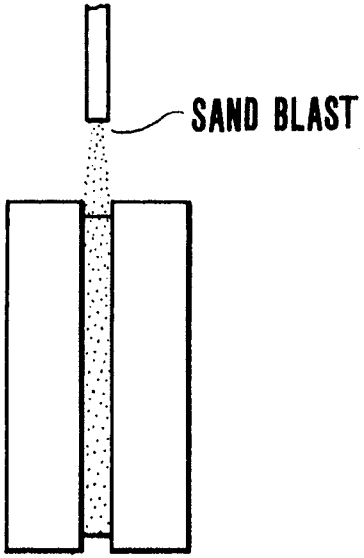
FIG. 11 is an illustration of a method for processing a rotary member having a circumferential groove with a roughened bottom surface.

The described effect for suppressing time variation of the powder supply rate can be attained also when the bottom surface of the circumferential groove is toughened by sand blasting, as shown in FIG. 11, instead of being provided with the circumferentially consecutive concavities and convexities.

EMBODIMENT 8

Figure 13:
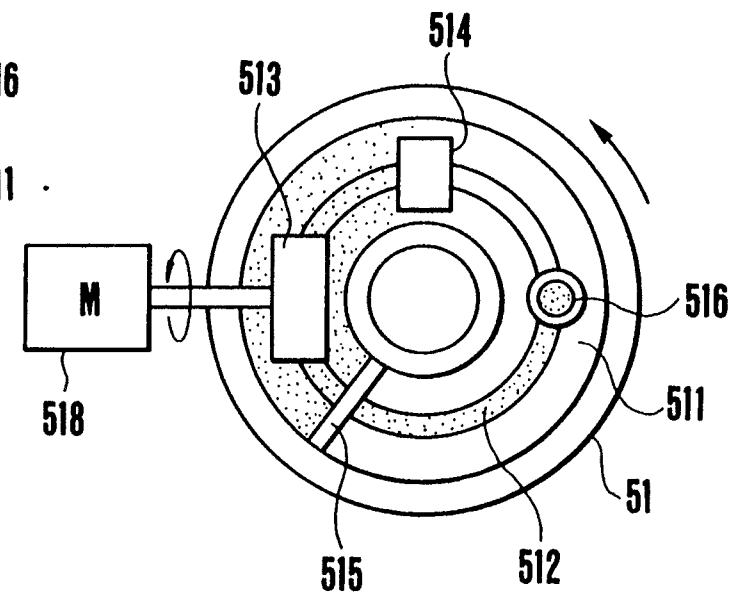
FIG. 13 is a plan view of the eighth embodiment.
Figure 12:
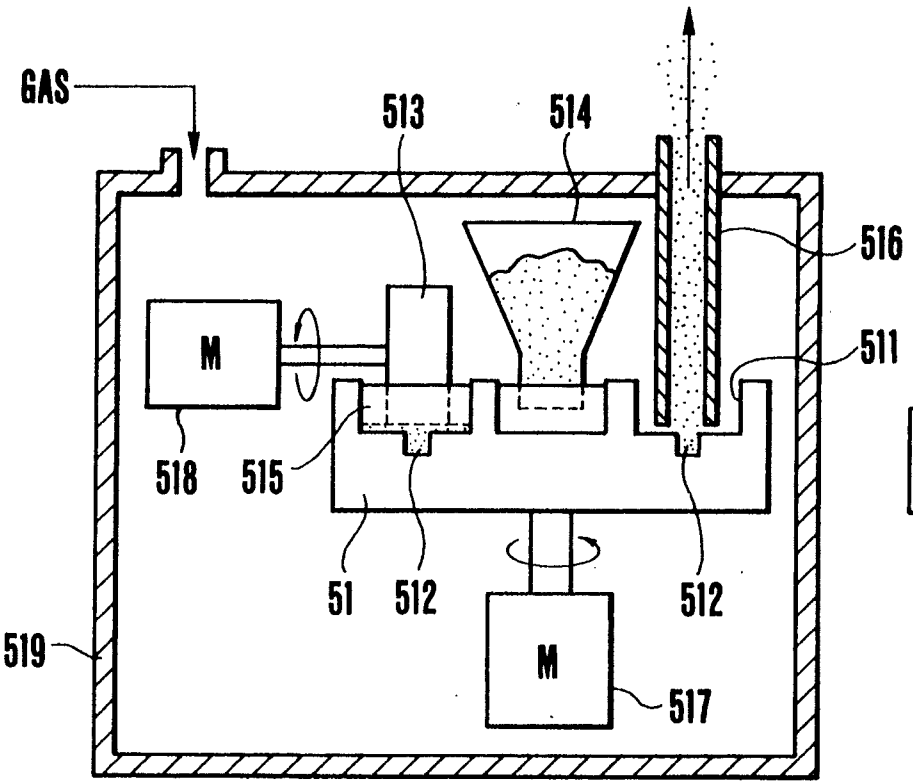
FIG. 12 is a schematic sectional front elevational view of a powder supplying apparatus as an eighth embodiment of the present invention, having a rotary member rotatable about a vertical axis and provided with a circumferential groove formed in the upper axial end surface thereof.

FIGS. 12 and 13 show an eighth embodiment in which the rotary member 51 is vertically arranged to rotate about a vertical axis. The rotary member 51 has one axial end surface in which an annular recess 511 is formed near the outer peripheral edge thereof. A circumferential groove 512 is formed in a radially mid portion of the recess 511. A powder pressing roll 513 is disposed so as to rotate in contact with a circumferential portion of the circumferential groove 512. A powder reservoir 514 is disposed at a position slightly upstream of the point of contact between the roll 512 and the rotary member 51 as viewed in the direction of rotation such that a powder is supplied from the bottom of the powder reservoir to a region near and upstream of the above-mentioned point of contact. A scraper 515 is disposed downstream of the point of contact between the powder pressing roll 512 and the rotary member 51, so as to scrape powder off the surface of the recess 511 at both sides of the circumferential groove 512. Numeral 516 denotes a powder delivering elongated tube which is disposed substantially at diametrically opposing end of the rotary member 51 to the powder pressing roll 513. Numeral 517 designates a motor for driving the rotary member 51, while 518 designates a motor for driving the powder pressing roll 513.

The components described above are accommodated in a hermetic vessel 519. A pressurized gas is supplied into the vessel 519 so as to flow from the interior of the vessel 519 into the elongated tube 516.

This embodiment is different from the preceding embodiments in that the rotary member is arranged to rotate about a vertical axis, but this embodiment produces substantially the same effect in realizing a continuous supply of powder at an extremely small constant rate as those exhibited by the preceding embodiments.

EMBODIMENT 9

FIGS. 14 to 17 illustrate an embodiment of the powder spraying apparatus employed in the production of a liquid crystal display panel. In these Figures, numeral 101 denotes a vessel which defines a space for spraying a powder and which seals this space from the ambient air. The vessel 101 has a door (not shown) so that a substrate 102 on which the powder is to be sprayed is brought into the vessel 101 and placed on the bottom of the vessel 101. The substrate 102 with the powder displayed thereon is taken out from the vessel 101 through the door.

A spray nozzle 103 is disposed at an upper portion of the space inside the vessel 101 substantially at the center of the latter. The spray nozzle 103 is adapted to make a predetermined oscillatory motion by the operation of an oscillating mechanism 104 shown in FIG. 16. The spray nozzle 103 may be connected, through a powder transportation pipe 105, to a powder supplying apparatus 106 which may be any one of the apparatuses described as first to eighth embodiments. The spray nozzle 103 is adapted to spray the powder in the form of micronized powder particles downward onto the substrate 102 by the assist of pressurized air.

The above-mentioned powder transportation pipe is intended for transporting the powder to be sprayed from the powder supplying apparatus 106 to the spray nozzle 103. It has been confirmed through experiments that a high micronizing effect is produced when the length to diameter ratio of this tube is determined to be 10 or greater, preferably about 20.

A gas discharge pipe 108 is connected at its one end to a lower portion of the vessel 101 and at its other end to a blower 109 so as to induce the air from the interior of the vessel 1 to the exterior.

Figure 15:
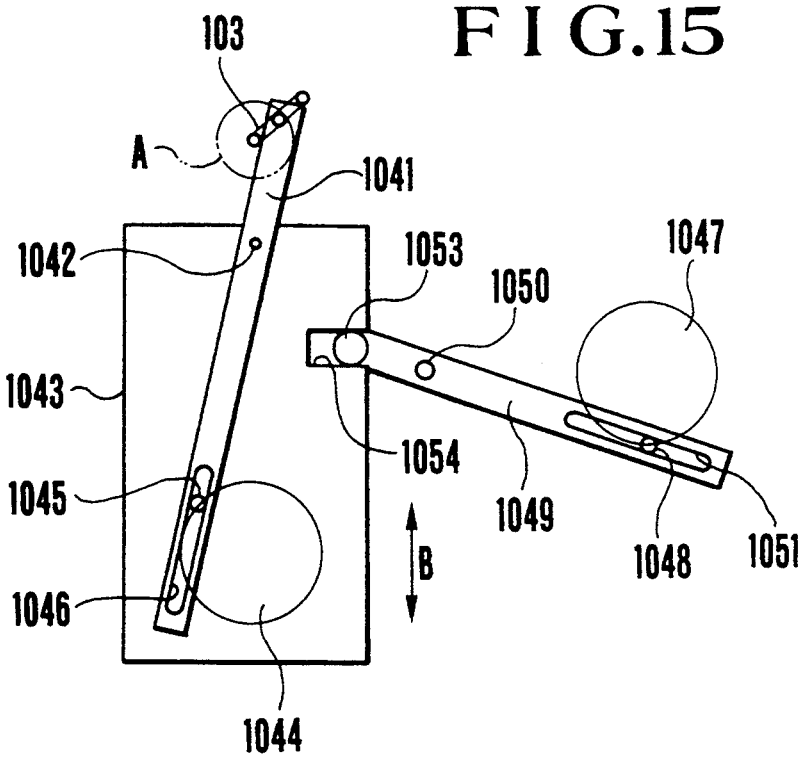
FIG. 15 is an illustration of a cam mechanism which causes an oscillatory motion of a spray nozzle employed in the ninth embodiment shown in FIG. 14.

A detailed description will be given of the oscillating mechanism 104 for effecting the oscillatory motion of the spray nozzle 103, with specific reference to FIG. 15. In this embodiment, the spray nozzle 103 is supported at its center by a spherical bearing (not shown) in such a manner as to be able to oscillate. The spray nozzle 103 is pivotally connected to one end of an oscillation link 1041. The oscillation link 1041 is rockable about a pin 1042 provided on a slider 1043 which is adapted to be moved reciprocately in the direction of arrows B in FIG. 15. Consequently, the linear reciprocating motion B of the slider 1043 causes a circular motion of the upper end of the spray nozzle 103 which is indicated by a circle A in FIG. 15.

Numeral 1044 denotes a first motor provided on the slider 1043. The first motor 1044 has a revolving member 1045 which is slidably received in a slot 1046 formed in the oscillation link 1041 for free movement along the slot 1046. Consequently, the operation of the first motor causes the oscillation link 1041 to rock about the pin 1042, thus realizing the movement of the upper end of the spray nozzle along the circular path. Numeral 1047 designates a second motor which is secured to a stationary portion (not shown) of the apparatus. The second motor 1047 has a revolving member 1048 which is freely received in a slot 1051 formed in a second oscillation link 1049 rockable about a pin 1050 which also is secured to a stationary portion. A projection or boss 1053 provided on the end of the second oscillation link 1049 engages with a recess 1054 formed in the slider 1043. Consequently, operation of the second motor 1047 causes the second oscillation link 1049 to rock about the pin 1050 which in turn causes the slider 1043 to reciprocatingly move in the directions of the arrow B.

Figure 14:
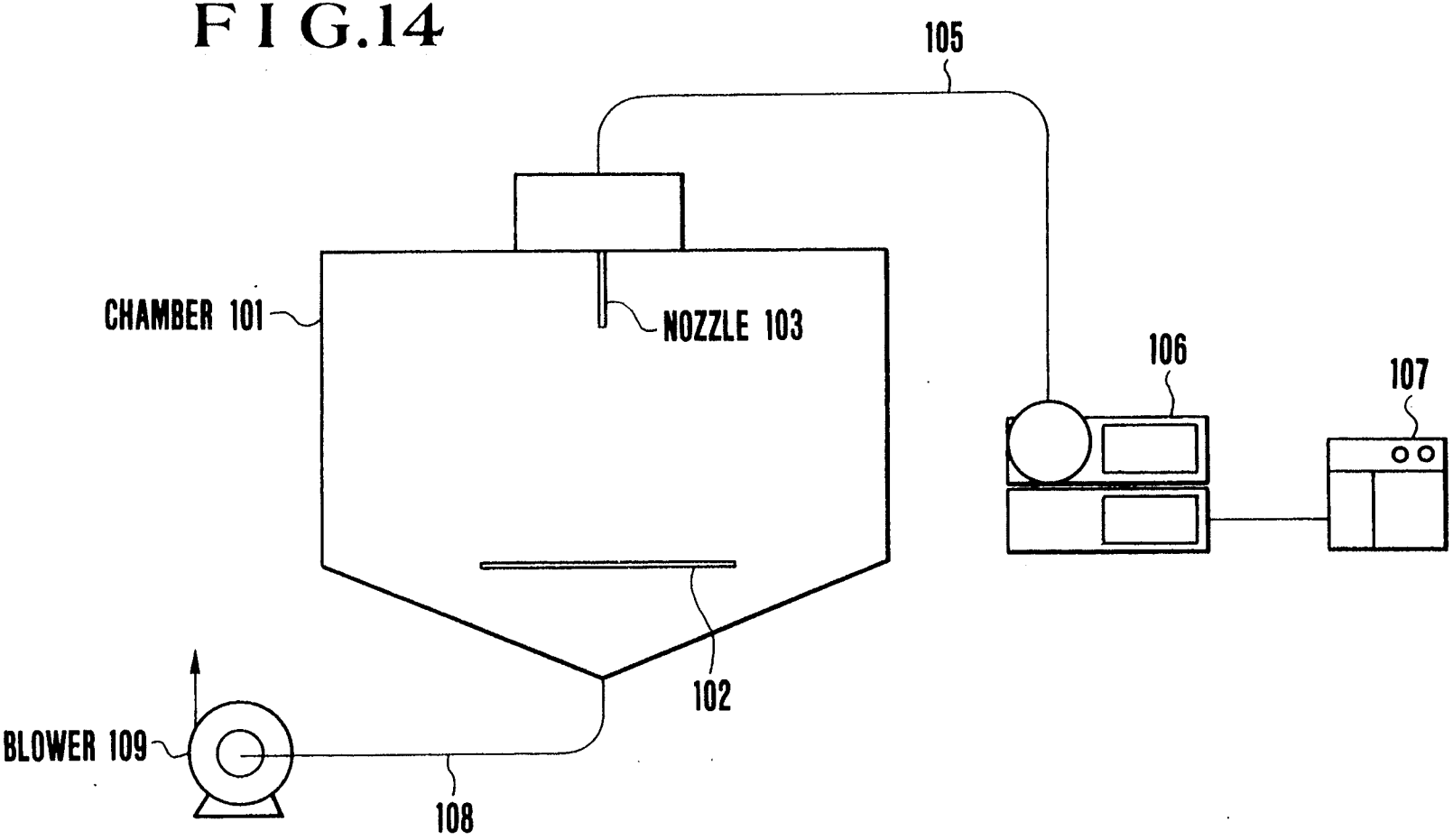
FIG. 14 is a schematic illustration of a powder spraying apparatus as a ninth embodiment of the present invention.

It is possible to realize a zig-zag movement of the lower end of the spray nozzle 103 of FIG. 14, thus spraying the powder along a zig-zag line, by suitably selecting the factors such as the ratio of speed between the first motor 1044 and the second motor 1047 and the lever ratios of the oscillation links can be suitably determined.

Figure 16:
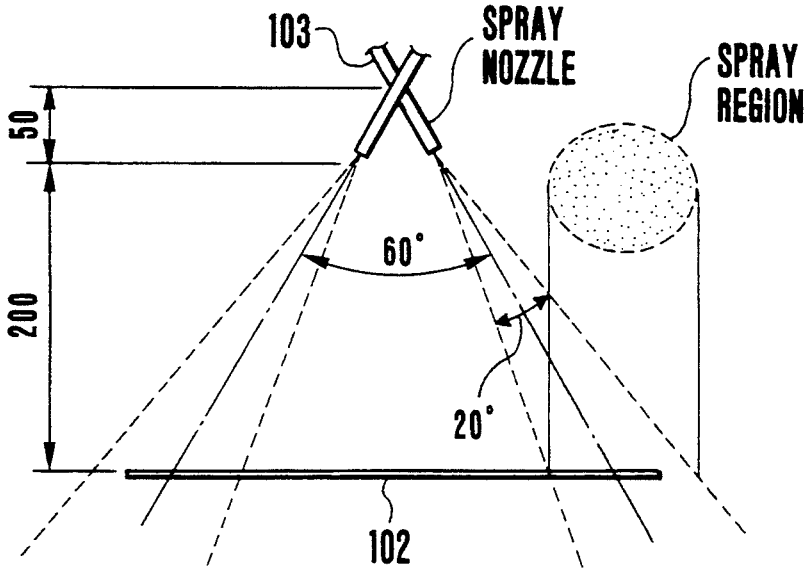
FIG. 16 is an illustration of an oscillatory motion of the spray nozzle employed in the ninth embodiment.
Figure 17:
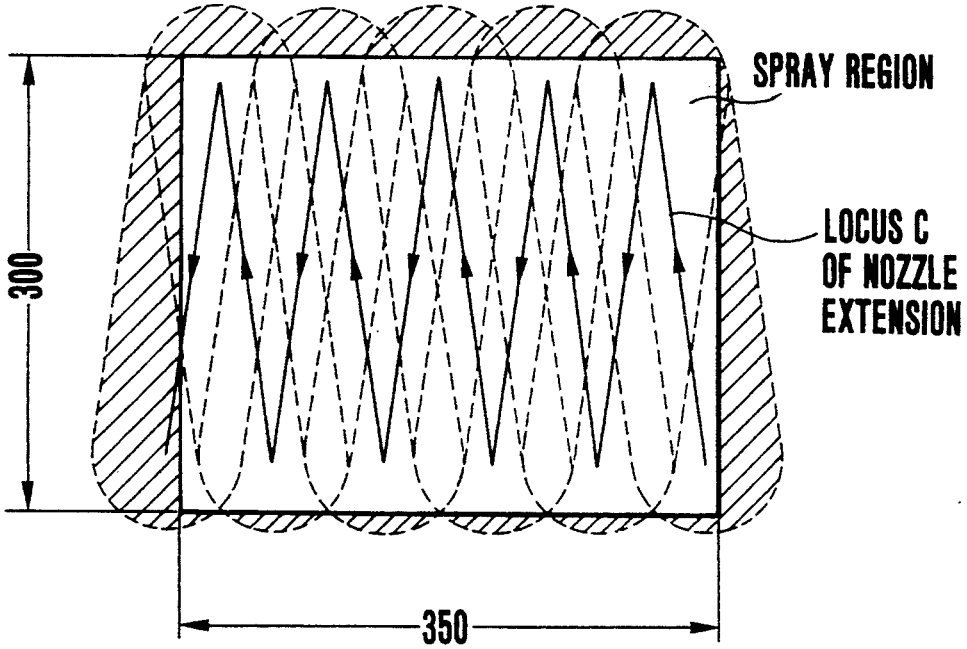
FIG. 17 is an illustration of the locus of movement of the extension of the spray nozzle drawn on a transparent substrate for a liquid crystal cell as attained by the operation of the cam mechanism shown in FIG. 16.
Figure 18:
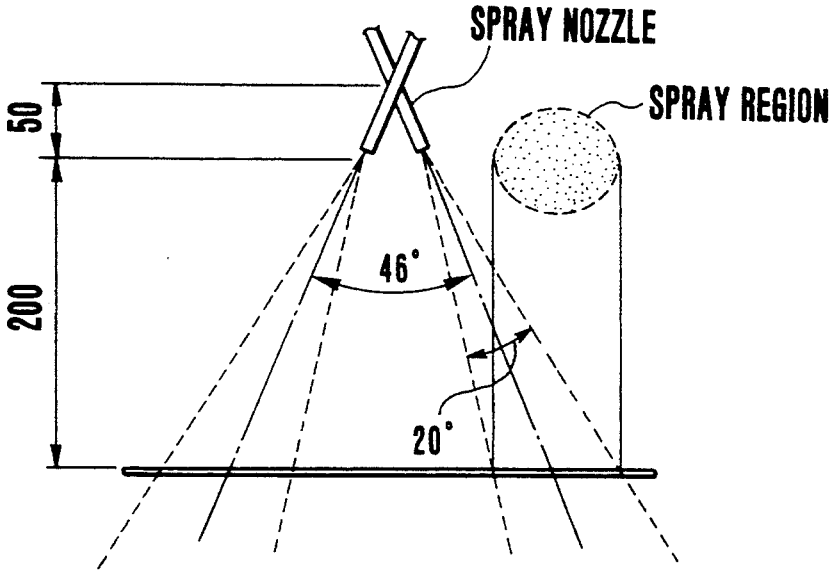
FIG. 18 is an illustration of a first comparative example representing a prior art and employing a mere circular movement of a spray nozzle in comparison with the present invention.

FIGS. 16 and 17 and arrangement in which the spray nozzle 103 of the spraying apparatus having the described construction is made to oscillate such that the extension of the nozzle draws a zig-zag line C shown in FIG. 17, so as to uniformly spray a powder on the substrate 102 of FIG. 14. The substrate has a length of 300 mm as measured in the direction normal to the sheet of drawing of FIG. 14 and a breadth of 350 mm as measured in the lateral direction in FIG. 14. This arrangement could spray the powder with a high degree of uniformity which well meets the demand for uniformity posed on known apparatuses, under such conditions that the angle of divergence of the powder sprayed from the spray nozzle 103 of 20° and the oscillation angle in the direction B of 60°, with a reduced distance of 200 mm between the substrate 102 and the lower end of the spray nozzle 103.

In FIG. 17, a broken line defines the belt-like region where the powder was sprayed along the zig-zag locus C. This region was so set as to cover an area which slightly spreads to the outside of the substrate surface on which the powder was to be sprayed. Such surplus area of spray of powder out of the substrate surface is hatched in FIG. 17.

COMPARATIVE EXAMPLE 1

A test spray was conducted in the same manner as the ninth embodiment except that the end of the spray nozzle 103 was rotated along a circular path. The distance between the substrate 102 and the spray nozzle 103 was determined to be equal to that in the ninth embodiment.

The apex angle of the cone drawn by the spray nozzle 103 was varied.

Figure 19:
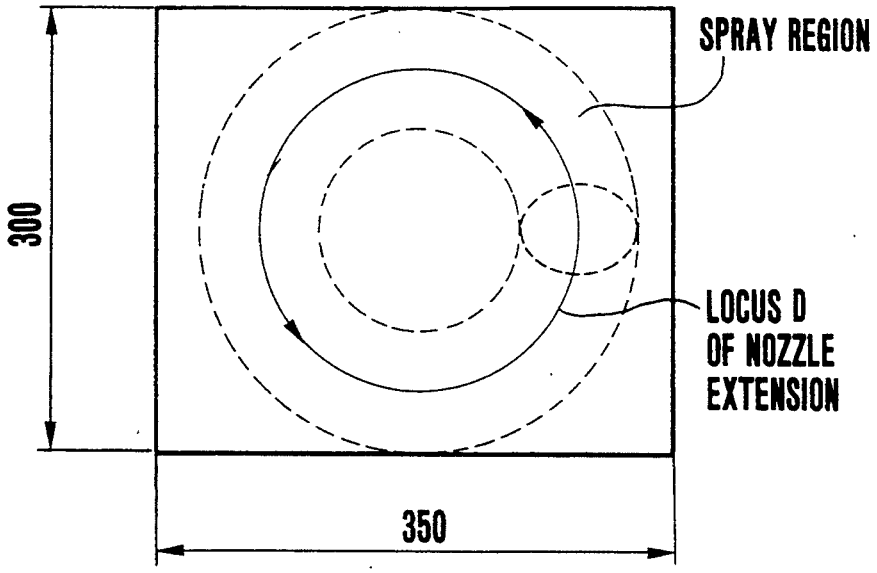
FIG. 19 is an illustration of the locus of movement of the extension of the spray nozzle drawn on a transparent substrate for a liquid crystal cell as attained in the first comparative example, showing regions where the powder particles are scattered.
Figure 20:
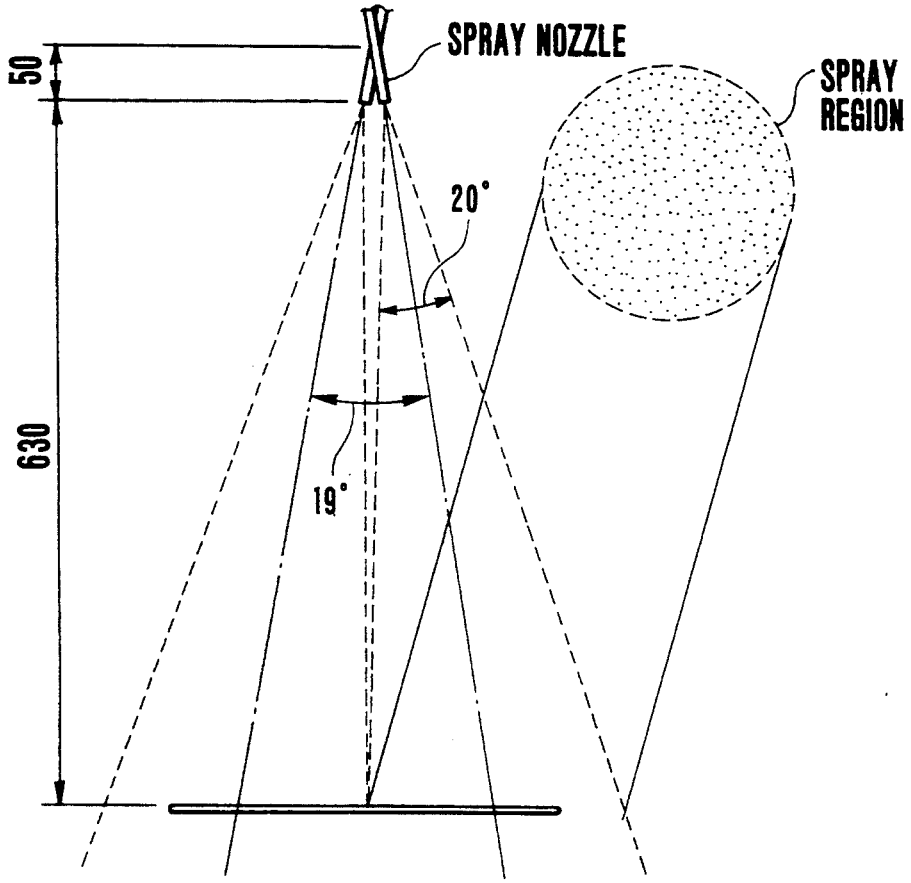
FIG. 20 is an illustration of a second comparative example representing a prior art and employing a mere circular movement of a spray nozzle.

A line D in FIG. 19 shows the circular locus of movement of the extension of the nozzle on the substrate as drawn when the apex angle was set to 46° by way of example. Broken lines in the same Figure show the belt-like region where the powder was sprayed along the above-mentioned circular locus. As will be seen from this Figure, regions of large areas where the powder was not sprayed were left at the center of the circular locus and in the peripheral portions of the substrate 102.

COMPARATIVE EXAMPLE 2

Test spray was conducted in the same manner as Comparative Example 1, with the distance between the substrate 102 and the spray nozzle 103 progressively increased while the apex angle of the cone drawn by the spray nozzle 103 was varied.

The test showed that a powder distribution equivalent to that provided by the ninth embodiment of the present invention could be obtained when the apex angle was 19°, with the distance between the substrate 102 and the spray nozzle 103 set to 630 mm.

The locus of movement of the extension of the spray nozzle on the substrate is shown by a line E, and broken lines show the outer ends of the region where the powder was sprayed. The portions of the spray region outside the substrate are hatched.

Figure 21:
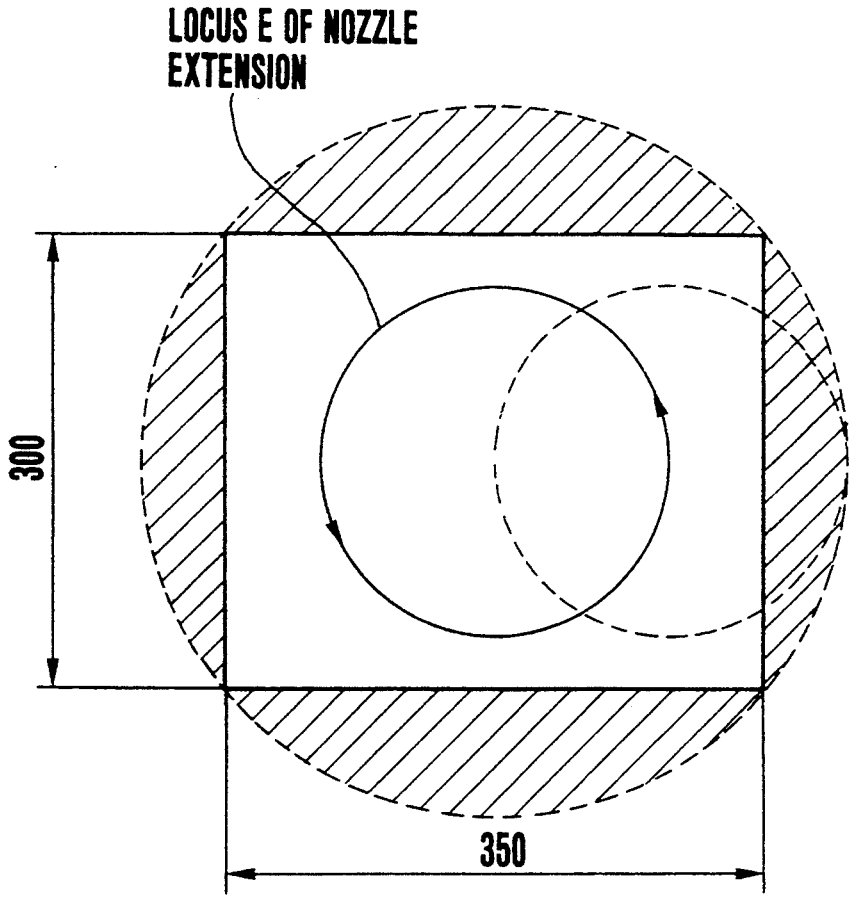
FIG. 21 is an illustration of the locus of movement of the extension of the spray nozzle drawn on a transparent substrate for a liquid crystal cell as attained in the second comparative example, showing regions where the powder particles are scattered.
Figure 22A:
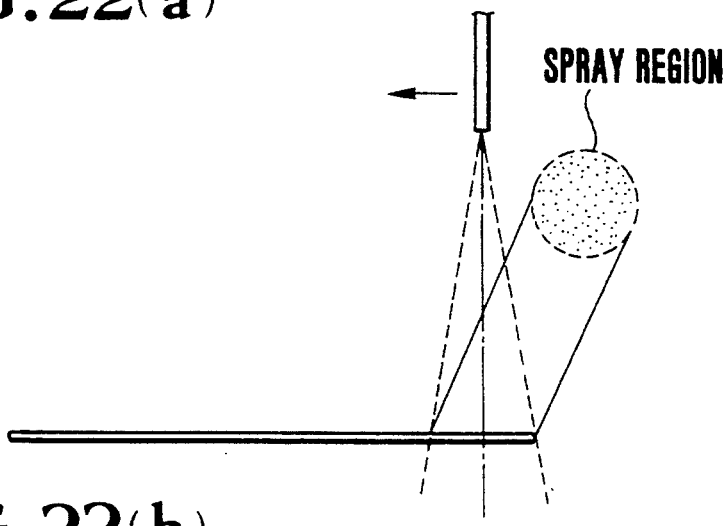
FIGS. 22(*a*) and 22(*c*) are illustrations of the locus of movement of the extension of the spray nozzle drawn on a transparent substrate for a liquid crystal cell as obtained when the spray is conducted in an ideal state, showing regions where the powder particles are scattered.
Figure 22B:
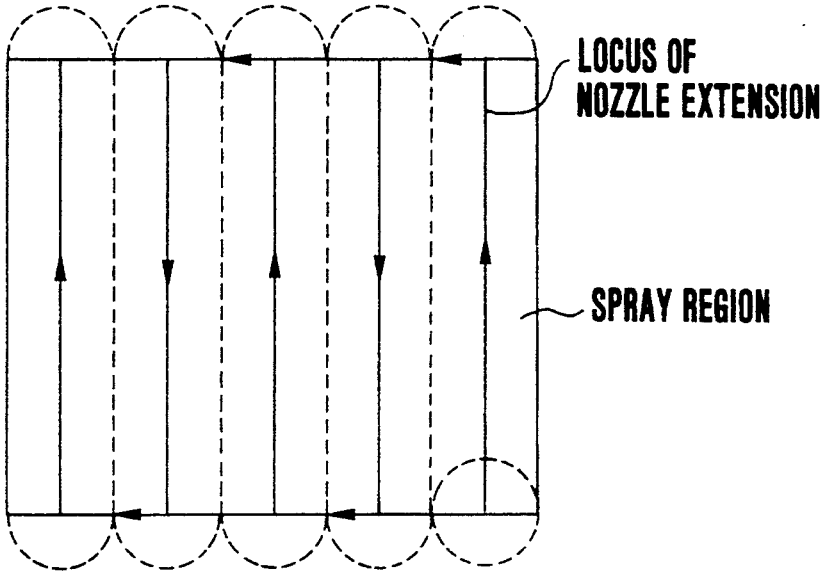
Figure 22C:
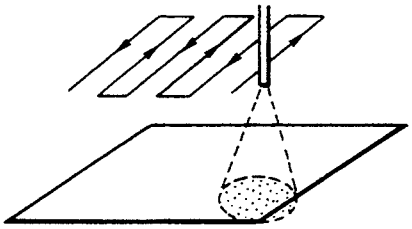
Figure 23:
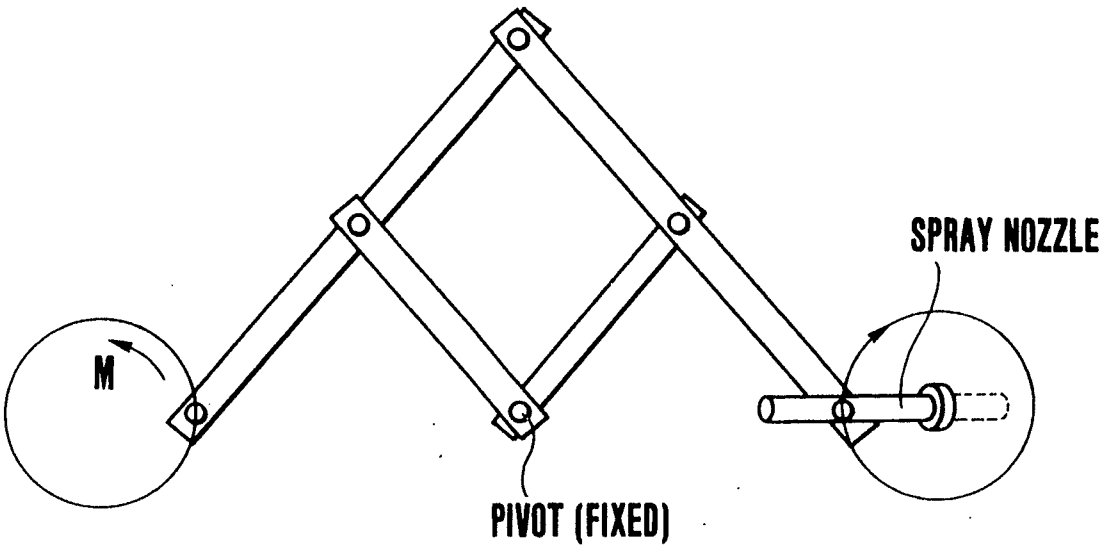
FIG. 23 is an illustration of a mechanism for effecting a circular movement of the spray nozzle in the first comparative example shown in FIG. 18.

In Comparative Example 2 as described, although a degree of uniformity which well compared with that in ninth embodiment was obtained, the distance between the substrate and the spray nozzle for attaining such high degree of uniformity was three times or more greater than that on the ninth embodiment. This means that the time required for completing the spray on a single substrate is undesirably prolonged. Furthermore, the consumption of the powder for realizing the uniformity equivalent to that in ninth embodiment was 25% or more greater than that in the ninth embodiment, as will be understood from a comparison between the hatched areas in FIGS. 17 and 21.

As will be understood from the foregoing description, the present invention offers various advantages.

First of all, it is to be noted that the powder supplying apparatus of the present invention makes it possible to supply a powder at an extremely small constant rate of several tens of grams per hour, with a constant density of powder particles.

The supply of the powder is terminated without delay after termination of the rotation of the rotary member, so that no transient phenomenon occurs over the entire period from the beginning to the end of the spraying operation, thus stabilizing the supply of the powder.

The powder supplying apparatus of the present invention employs fewer movable mechanical parts, reducing not only the size of the apparatus but also the degree of contamination of the powder which occurs due to contact and wear of mechanical parts.

The effect for regulating the rate of supply of the powder is enhanced when the powder supplying apparatus has a pulsation suppressing mechanism which reduces pulsating variation in the rate of supply of the powder.

The powder spraying apparatus in accordance with the other aspect of the present invention makes it possible to reduce the distance between the substrate and the nozzle to half or less than that required in the conventional apparatus which employs a mere circular rotation of the spray nozzle at a fixed position, for a given design specification of the spraying accuracy. Consequently, the height of the apparatus is remarkably reduced and the processing is quickened by virtue of the reduction in the distance to be traveled by the powder directed from the spray nozzle the substrate.

Furthermore, as will be understood from the comparison between the ninth embodiment of the present invention and comparative examples, the total consumption of the powder, which is the sum of the area over which the powder is to be sprayed and the area outside such spray area, is much smaller in the invention than in conventional apparatuses represented by the comparative examples. Consequently, the present invention contributes to effective use of natural resources and to reduction in the cost of the product by virtue of reduction in the amount of powder used in unit substrate.

What is claimed is:

1. A powder supplying apparatus, comprising:

a powder storage section;

a rotary member rotatable about a fixed axis and having a circumferential groove formed in the peripheral surface thereof, said groove extending in the direction of rotation and being adapted to be charged with powder;

powder charging means for charging said circumferential groove with said powder from said powder storage section continuously at a constant rate in accordance with the rotation of said rotary member;

a powder discharging elongated tube having an open end facing the opening of said circumferential groove leaving a minute gap therebetween;

a vessel which defines a space which accommodates said rotary member and the open end of said elongated tube and which is sealed from the ambient air; and means for establishing a predetermined gas pressure differential between the other end of said elongated tube and the interior of said vessel so as to create a continuous flow of gas from the interior of said vessel towards said other end of said elongated tube.

2. A powder supplying apparatus according to claim 1, wherein said powder charging means for charging said circumferential groove of said rotary member with said powder includes a powder charging roll which rotates in contact with the surface of said rotary member in which said circumferential groove is formed.

3. A powder supplying apparatus according to claim 5, wherein said powder charging roll has consecutive concavities and convexities alternately appearing in the direction of rotation of said rotary member.

4. A powder supplying apparatus according to claim 1, further comprising scraping means for doctoring the surface of said powder charged in said circumferential groove, thereby regulating the amount of said powder charged in said circumferential groove.

5. A powder supplying apparatus according to claim 1, wherein said means for establishing a predetermined gas pressure differential between the other end of said elongated tube and the interior of said vessel so as to create a continuous flow of gas from the interior of said vessel towards said other end of said elongated tube includes means for pressurizing the interior of said vessel.

6. A powder supplying apparatus according to claim 1, wherein the bottom of said circumferential groove is roughened or has convexities and concavities appearing alternately in the direction of rotation of said rotary member.

7. A powder supplying apparatus according to claim 1, wherein said means for establishing a predetermined gas pressure differential between the other end of said elongated tube and the interior of said vessel so as to create a continuous flow of gas from the interior of said vessel towards said other end of said elongated tube includes ejector means provided on the downstream end of said elongated tube.

* * * * *